United States Patent [19]

Baker et al.

[11] 4,407,308

[45] Oct. 4, 1983

[54] SMOKING ARTICLES

[75] Inventors: Richard R. Baker, Dibden Purlieu; Federick J. Dashley, New Milton, both of England

[73] Assignee: British-American Tobacco Company Limited, London, England

[21] Appl. No.: 353,156

[22] Filed: Mar. 1, 1982

[30] Foreign Application Priority Data

Mar. 6, 1981 [GB] United Kingdom ..... 8107118

[51] Int. Cl.[3] ..... A24D 1/02

[52] U.S. Cl. ..... 131/336; 131/358; 131/365; 131/331; 131/334; 162/139

[58] Field of Search ..... 131/358, 365, 336, 331, 131/334; 162/39

[56] References Cited

U.S. PATENT DOCUMENTS 3,744,496 7/1963 McCarty et al. ..... 131/365
3,911,932 10/1975 Houck et al. ..... 131/336
4,088,142 5/1978 Horsewell et al. ..... 131/336
4,225,636 9/1980 Cline et al. ..... 131/365
4,231,377 11/1980 Cline et al. ..... 131/365
4,238,283 12/1980 Greene et al. ..... 131/365

*Primary Examiner*—Vincent Millin
*Attorney, Agent, or Firm*—Kane, Dalsimer, Kane, Sullivan & Kurucz

[57] ABSTRACT

A smoking article such as a cigarette has a rod of smoking material wrapped in a wrapper of which the substantially uniform air permeability due to viscous flow is not more than 3 and preferably not more than 2 Coresta Units and of which the Do/t value is in the range of 0.08 to 0.65 cm $sec^{-1}$, preferably 0.15 to 0.25 cm $sec^{-1}$. The length of the rod of smoking material may suitably be within a range of 25 to 55 mm. A reduction in side-stream TPM delivery of 40% or more can be obtained.

The invention is also concerned with a smoking-article wrapper material which satisfies the above permeability and Do/t value requirements.

11 Claims, No Drawings

SMOKING ARTICLES

This invention relates to smoking articles, particularly but not exclusively cigarettes.

Increased attention has been paid of late to reduction of the sidestream smoke which is emitted from cigarettes while smouldering between puffs. A determinant of the sidestream generation of a cigarette is the burn rate of the cigarette during smoulder periods between puffs. Thus, by employing papers which give low cigarette burn rates, sidestream generation can be reduced. As is known to those skilled in the art, the burn rate of cigarette paper is related to the inherent permeability thereof. The lower the permeability, the lower, generally speaking, is the burn rate. Consequently, in order to obtain low rates of sidestream emission, resort may be had to papers of low permeability value.

Currently the lowest permeability value of cigarette paper used in conventional cigarette production is about 5 Coresta Units, because attempts to use lower permeabilities have resulted in the cigarettes failing to remain alight if left to smoulder for even a short time. The present invention is predicated upon the discovery that paper wrappers having significantly lower permeability values can be used, while acceptable combustion-sustaining characteristics of the smoking articles can at the same time be retained, if paper is selected for which the ratio of the coefficient ($D_o$) of diffusion of oxygen through nitrogen in the paper and the thickness (t) of the paper satisfies specified requirements. The diffusion coefficient, or diffusivity, of a gas in a binary gas mixture is defined as the amount of gas passing in unit time across a plane of unit area when the concentration gradient is unity. Gases diffuse more slowly when the diffusion is by way of porous solids such as paper than through the unrestricted gas phase. The diffusion coefficient of gases through paper is measured by a method described by Drake et al. and published in the International Journal of Heat and Mass Transfer, 1980, Volume 23, pages 127–134. If the diffusion coefficient is quoted in the units $cm^2\ sec^{-1}$ and paper thickness in cm, then the ratio $D_o/t$ has the units $cm\ sec^{-1}$. Suitably the diffusion coefficient is stipulated in relation to oxygen but it could be correspondingly stipulated, for purposes of convenience of measurement, in terms of another gas.

The air permeability of a paper is expressed, in Coresta Units, as the amount of air in cubic centimeters which passes through one square centimeter of the paper in one minute at a constant pressure difference of 1.0 kilopascal.

Inherently porous cigarette paper consists of an interlocking network of fibres, usually substantially wholly or mainly cellulose fibres, interspersed with particles of a filler, chalk for example. Openings in this fibre/filler matrix are of the order of 1 $\mu m$ wide. This is small compared to the paper thickness (usually 20 to 40 $\mu m$) and the flow of air through these openings in the paper is governed by viscous forces. However, when cigarette paper is perforated after the paper-making process, by an electrostatic or mechanical process for example, the perforation holes are relatively large, usually having mean diameters of the same order of magnitude as the paper thickness. The flow of air through these perforation holes is governed by inertial forces.

The total flow through perforated cigarette paper thus consists of two components, namely viscous flow through the porous structure of the paper inherent from the paper-making process, and inertial flow through the perforation holes. The total flow through perforated paper may be expressed by:

$$Q = ZAP + Z'A(P)^n$$

where

Q is the air flow ($cm^3\ min^{-1}$),

A is the area of paper ($cm^2$) exposed to the flowing air,

P is the pressure difference across the paper (kilopascal),

Z is the permeability of the paper due to viscous flow through the openings inherent from the paper-making process in Coresta Units ($cm\ min^{-1}$ $kilopascal^{-1}$), Z' is the permeability of the paper due to inertial flow through the perforation holes ($cm\ min^{-1}$ $kilopascal^{-1/n}$), and n is a constant for a given set of perforation holes, where $0.5 \leqq n < 1.0$. The exact value of n depends on the size of the perforation holes in the paper.

From the above equation, the "total permeability" of perforated cigarette paper is equal to (Z+Z'). The relative values of Z and Z' for a given perforated paper can be obtained by measuring the flow through the paper at a series of pressures across the paper, and numerically regressing the Q/P data in the above equation, using a value of n in accordance with the mean size of the perforation holes in the paper.

The present invention provides a smoking article, a cigarette for example, comprising a rod of smoking material wrapped in a wrapper of which the air permeability due to viscous flow is substantially uniform and is, substantially, not more than 3 Coresta Units and of which the $D_o/t$ value is, substantially, in the range of 0.08 to 0.65 $cm\ sec^{-1}$.

Preferably the wrapper, having air permeability and $D_o/t$ values satisfying the above-stated physical limitations, consists of a single layer of paper. Advantageously the $D_o/t$ value is not more than 0.25 $cm\ sec^{-1}$ and not less than 0.15 $cm\ sec^{-1}$.

Also, in accordance with the invention, a smoking-article wrapper material, preferably in the form of a single layer of paper, has an air permeability due to viscous flow which is, substantially, not more than 3 Coresta Units and a $D_o/t$ value which is, substantially, in the range of 0.08 to 0.65 $cm\ sec^{-1}$.

If the wrapper contains large holes and the resistance to air flow through the wrapper is thus due to inertial as well as viscous forces, it may be that the overall permeability is more than 3 Coresta Units, but the permeability due to the viscous flow should not be more than about 3 Coresta Units. The air permeability of the wrapper due to viscous flow is preferably not more than 2 Coresta Units and conveniently it is about 1 Coresta Unit. The permeability of the wrapper due to viscous flow should be uniform in the sense that the permeability of the paper used to form the wrapper when measured at any selected zone thereof is the same as that as measured at any other zone thereof. Suitably the desired viscous flow permeability of the paper wrapper is provided as an inherent property of the paper resulting from the paper-making process.

A minimum acceptable $D_o/t$ value within the range of about 0.08 to about 0.65 $cm\ sec^{-1}$ will depend to a limited extent on a number of design factors of the smoking article, the type and form of the tobacco or other smoking material and the diameter of the smoking material rod for example.

The rate of production of sidestream Total Particulate Matter (TPM), i.e. the sidestream TPM delivery per cigarette divided by the time over which the cigarette is smoked, correlates with the amount of visible sidestream smoke which is observed issuing from the cigarette. For commercial cigarettes having conventional cigarette papers, the rate of production of sidestream TPM is greater than about 3.0 mg $min^{-1}$. In the case of cigarettes made in accordance with the present invention, it is possible to obtain values of 2.0 mg $min^{-1}$ or less.

Cigarettes may be made in accordance with the present invention which exhibit a reduction of 40% or even 60% or more in total sidestream TPM delivery compared, on an equal puff-number basis, with comparable cigarettes having conventional cigarette papers. The deliveries of other sidestream-smoke components, carbon monoxide and carbon dioxide for example, are also reduced by use of the invention.

Cigarettes embodying the invention have a static burn rate lower than that of conventional cigarettes. However, by selection of relevant design variables, cigarettes may readily be provided which remain lit when smoked at one puff per minute. Thus the cigarettes in accordance with the invention not only have the advantage of low sidestream-smoke production, but they may also be such as to self-extinguish when left to smoulder for a prolonged period.

The wrapper material may include chemical additives or fillers. Chemical additives may be included, at a loading of 0.5% to 4%, to provide required ash and/or smoulder characterstics. Suitable additives are phosphates, mono-ammonium or disodium phosphate for example, citrates, sodium or potassium citrate for example, tartrates, formates, lactates and acetates. Appropriate fillers are titanium dioxide, magnesium oxide and calcium carbonate.

The invention will now be further explained, by way of example, with reference to four forms of cigarette A, B, C and D, in accordance with the invention and, by way of comparison, with reference to three forms of cigarette of conventional design E, F and G.

Details for the cigarette papers of the cigarettes A-G are given in Table 1.

TABLE 1

| Cigarette | Permeability (Coresta Units) | $D_o$ ($cm^2$ $sec^{-1}$) | t (cm) | $D_o/t$ (cm $sec^{-1}$) |
|---|---|---|---|---|
| A | 0.7 | 0.00032 | 0.0030 | 0.11 |
| B | 1.0 | 0.0010 | 0.0040 | 0.25 |
| C | 1.5 | 0.0021 | 0.0035 | 0.60 |
| D | 3.0 | 0.00070 | 0.0030 | 0.23 |
| E and G | 25 | 0.0070 | 0.0040 | 1.75 |
| F | 50 | 0.0125 | 0.0039 | 3.21 |

Each of the cigarettes B, C, E and F comprised a tobacco rod 59 mm long and of 24.75 mm circumference attached to a 25 mm long cellulose-acetate filter. The tobacco blend and the filter specification were the same for each of these cigarettes. The cigarettes A, D and G were plain cigarettes having a tobacco-rod length of 70 mm and a circumference of 25 mm. The filter cigarettes were smoked to tobacco-rod butt lengths of 8 mm and the plain cigarettes to butt lengths of 23 mm under standard smoking conditions of a puff of 35 cubic centimeters volume and 2 seconds duration every minute to determine mainstream and sidestream deliveries of TPM and nicotine. The results are given in Table 2.

TABLE 2

| | Mainstream | | Sidestream | | |
|---|---|---|---|---|---|
| Cigarette | TPM (mg/cig) | Nicotine (mg/cig) | TPM (mg/cig) | Nicotine (mg/cig) | Puff No. |
| A | 40.8 | 2.30 | 17.6 | 2.04 | 15.0 |
| B | 26.4 | 1.56 | 20.6 | 2.73 | 19.1 |
| C | 22.2 | 1.49 | 21.7 | 2.60 | 16.1 |
| D | 37.7 | 2.00 | 21.2 | 2.11 | 12.3 |
| E | 16.0 | 1.31 | 34.0 | 4.58 | 11.7 |
| F | 15.3 | 1.21 | 31.9 | 4.30 | 11.3 |
| G | 26.7 | 1.70 | 27.6 | 3.60 | 9 |

As may be seen from Table 2 the cigarettes B and C exhibited sidestream deliveries of TPM and nicotine which were considerably lower than the corresponding deliveries of the cigarettes E and F of conventional design. Moreover, the cigarettes B and C smoked with considerably higher puff numbers than those of the cigarettes E and F, while at the same time having acceptable combustion sustaining characteristics. Similarly the cigarettes A and D had higher puff numbers than the plain control cigarettes G.

Table 3 shows percentage reductions of sidestream smoke-component deliveries for plain cigarettes A and D as compared with control cigarettes having conventional cigarette papers, the puff numbers being equal for the test and control cigarettes.

TABLE 3

| Cigarette | TPM | Nicotine | PMWNF | CO | $CO_2$ |
|---|---|---|---|---|---|
| A | 62 | 66 | 61 | 57 | 40 |
| D | 44 | 57 | 41 | 41 | 32 |

PMWNF is an abbreviation for "particulate matter water and nicotine free".

The rates of sidestream TPM production for cigarettes A and D were determined and found to be 1.3 and 1.9 mg $min^{-1}$ respectively.

The enhanced puff-number phenomenon noted in relation to Table 2 can be utilised to reduce the deliveries per cigarette by reducing the quantity of tobacco in each tobacco rod while providing the smoker with a puff number in the puff-number region to be experienced with conventional cigarettes. Thus if the burn length of cigarette B is reduced from 51 mm to 30 mm, that is to say the total tobacco rod length is reduced from 59 mm to 38 mm, the puff number will be reduced from 19.1 to 11.3, i.e. to the puff number value of conventional cigarette F. This would result in reduced sidestream deliveries of 12.1 mg TPM and 1.61 mg Nicotine. Similarly, the puff number of cigarette C could be reduced from 16.1 to 11.3 by reducing the burn length from 51 mm to 36 mm, resulting in reduced sidestream deliveries of 15.3 mg TPM and 1.84 mg Nicotine. For both of the reduced burn length cigarettes B and C the mainstream TPM deliveries would approximate to that of the cigarette F. It is contemplated that the invention can be usefully applied with tobacco-rod lengths in the range of 25 to 55 mm.

As will be appreciated, the use of a wrapper in accordance with the invention provides the designer of smoking articles, particularly cigarettes, with a valuable tool for controlling sidestream deliveries, whether considered absolutely or relatively and/or in conjunction with mainstream deliveries, in order to obtain acceptable smoking articles having combinations of smoking properties not obtainable or not readily obtainable heretofore, this moreover by relatively simple means not involving essential departures from current manufacturing methods or incurring unacceptable drawbacks such as poor combustion-sustaining characteristics.

What is claimed is:

1. A smoking article comprising a rod of smoking material wrapped in a wrapper of which the air permeability due to viscous flow is substantially uniform and is, substantially, not more that 3 Coresta Units and of which the Do/t value is, substantially, in the range of 0.08 to 0.65 cm $sec^{-1}$.

2. A smoking article according to claim 1, wherein the Do/t value of the said wrapper is not lower than 0.15 cm $sec^{-1}$.

3. A smoking article according to claim 1 or 2, wherein the Do/t value of the said wrapper is not more than 0.25 cm $sec^{-1}$.

4. A smoking article according to claim 1 or 2, wherein the said wrapper is a paper wrapper.

5. A smoking article according to claim 1 or 2, wherein the said air permeability is not more than 2 Coresta Units.

6. A smoking article according to claim 1 or 2, wherein the length of the said rod of smoking material is within a range of 25 to 55 mm.

7. A smoking article according to claim 1 or 2, wherein, on smoking of the said article, the rate of production of sidestream TPM is not more than about 2 mg $min^{-1}$.

8. A smoking article according to claim 1, wherein, on smoking of the said article, a sidestream TPM delivery reduction of at least 40% is obtained compared, on an equal puff-number basis, with a cigarette having a conventional cigarette paper.

9. A smoking article according to claim 8, wherein the said sidestream TPM delivery reduction is 60% or more.

10. A smoking-article wrapper material of which the air permeability is, substantially, not more than 3 Coresta Units and the Do/t value of which is, substantially, in the range of 0.08 to 0.65 cm $sec^{-1}$.

11. A wrapper material according to claim 10, wherein the Do/t value is not lower than 0.15 cm $sec^{-1}$.

* * * * *